US008403066B2

(12) United States Patent
Meyyappan et al.

(10) Patent No.: US 8,403,066 B2
(45) Date of Patent: Mar. 26, 2013

(54) CONTROL LINE HYBRID JUNCTION ASSEMBLY

(75) Inventors: Ramaswamy Meyyappan, Katy, TX (US); Yasser El-Khazindar, Dokki (EG); Thomas D. MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 389 days.

(21) Appl. No.: 12/703,189

(22) Filed: Feb. 9, 2010

(65) Prior Publication Data

US 2010/0206582 A1 Aug. 19, 2010

Related U.S. Application Data

(60) Provisional application No. 61/151,823, filed on Feb. 11, 2009.

(51) Int. Cl.
*E21B 19/16* (2006.01)
*E21B 17/00* (2006.01)

(52) U.S. Cl. ..... 166/378; 166/380; 166/242.6

(58) Field of Classification Search ..... 166/380, 166/242.6, 378; 285/123.1, 124.5
See application file for complete search history.

(56) References Cited

U.S. PATENT DOCUMENTS

| | | | | |
|---|---|---|---|---|
| 4,143,712 | A | 3/1979 | James et al. | |
| 4,705,353 | A | 11/1987 | Wagoner | |
| 4,842,068 | A | 6/1989 | Vercaemer et al. | |
| 5,509,202 | A * | 4/1996 | Abdow | 29/871 |
| 5,947,198 | A * | 9/1999 | McKee et al. | 166/66.4 |
| 6,582,145 | B1 * | 6/2003 | Malone et al. | 403/31 |
| 6,886,638 | B2 | 5/2005 | Ahmed et al. | |
| 6,919,512 | B2 | 7/2005 | Guven et al. | |
| 6,959,763 | B2 * | 11/2005 | Hook et al. | 166/250.17 |
| 7,154,413 | B2 | 12/2006 | Veneruso et al. | |
| 7,487,830 | B2 * | 2/2009 | Wolters et al. | 166/242.6 |
| 2003/0111796 | A1 * | 6/2003 | Kohli et al. | 277/322 |
| 2005/0194184 | A1 | 9/2005 | Gleitman | |
| 2005/0213898 | A1 | 9/2005 | Rubinstein | |
| 2007/0237467 | A1 * | 10/2007 | Rubinstein et al. | 385/99 |
| 2008/0061510 | A1 | 3/2008 | Li et al. | |
| 2008/0271924 | A1 | 11/2008 | Lurie et al. | |
| 2009/0211753 | A1 | 8/2009 | Emtiazian et al. | |
| 2009/0229817 | A1 * | 9/2009 | Partouche | 166/242.6 |
| 2009/0243282 | A1 | 10/2009 | Verzwyvelt et al. | |
| 2009/0277646 | A1 | 11/2009 | Guven | |
| 2011/0192596 | A1 * | 8/2011 | Patel | 166/250.11 |
| 2011/0266008 | A1 * | 11/2011 | Worrall et al. | 166/385 |

FOREIGN PATENT DOCUMENTS

GB 2366817 A 3/2002

* cited by examiner

*Primary Examiner* — Brad Harcourt
*Assistant Examiner* — Michael Wills, III
(74) *Attorney, Agent, or Firm* — Brandon S. Clark

(57) ABSTRACT

A hybrid junction assembly is provided. The hybrid junction assembly may comprise a junction body configured to sealingly couple to a first control line and a second control line. In addition, the assembly may include a transfer conduit configured to fit within a hybrid control line such that an annulus is formed between the transfer conduit and the hybrid control line. The first control line and the transfer conduit may form a first communication pathway and the second control line and the annulus may form a second communication pathway. The transfer conduit and the hybrid control line may be sealingly coupled to the junction body.

20 Claims, 5 Drawing Sheets

CONTROL LINE HYBRID JUNCTION ASSEMBLY

CROSS REFERENCE TO RELATED APPLICATIONS

This application claims the benefit under 35 U.S.C. §119 (e) of U.S. Provisional Application Ser. No. 61/151,823 entitled "Control Line Hybrid Junction Assemblies," filed Feb. 11, 2009, which is hereby incorporated by reference.

BACKGROUND

In the oilfield industry for example, a plurality of control lines are typically run through downhole structures in a well bore. In general, control lines provide conduits for a variety of communication media, including hydraulic fluid, electrical conductors, fiber optic cables, and the like, that may be used to power, control and otherwise communicate with one or more downhole tools placed in the well. For example, a flow control valve installed downhole in a completion may be operated via hydraulic fluid pressure and/or pressure pulses communicated from the surface via the control line to an actuator mechanism of the valve. In addition, a fiber optic cable may be run through a control line and used, for example, to measure the temperature profile of the well or to communicate an operational command to a downhole tool.

With the growing popularity of multi-zone intelligent completions and the increased need for reservoir monitoring, the demand for increasing the number of control lines being utilized in a completion has grown. At the same time, the ability to run these control lines through limited space and the typically tight tolerances existing between structures in downhole completions and in well components has become a challenge. In addition, existing wellheads may have a limited number of penetrations, thus rendering it impractical to increase the number of control lines in order to add functionality to the completion. Increasing the number of control lines also presents difficulties at downhole locations where the control lines pass through completion components, such as tools or seals (e.g., packers, for example). Providing penetrations through a component through which the control lines can pass increases the complexity of a tool and compromises its ability to provide a seal. Reducing the number of control lines passing through a component would aid in improving the reliability and robustness of a well system.

SUMMARY

In accordance with one embodiment of the disclosure, a hybrid junction assembly may comprise a junction body to sealingly couple to a first control line and a second control line. In addition, the assembly may comprise a hybrid control line sealingly coupled to the junction body. The hybrid control line may contain a first passageway and a second passageway. The first control line is coupled to the first passageway to establish a first pathway through the junction body, and the second control line is coupled to the second passageway to establish a second pathway through the junction body.

In accordance with another embodiment of the disclosure, a method may be provided for reducing the number of control lines deployed through a downhole completion component. The method may include coupling a first control line and a second control line to a first junction body and coupling a hybrid control line to the first junction body. In addition, the method may further include establishing a first communication pathway through the first junction body between the first control line and the hybrid control line, and establishing a second communication pathway through the first junction body between the second control line and the hybrid control line.

Other or alternative features will become apparent from the following description, from the drawings, and from the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of the present disclosure. However, it will be understood by those skilled in the art that embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Embodiments of the disclosure utilize one or more control line management devices, referred to as hybrid junction assemblies, to combine power, actuation, monitoring, and other communication signals from multiple individual control lines into a single hybrid control line. The hybrid control line may then be deployed across a completion component to be bypassed (e.g. a packer, valve, mandrel, tool, wellhead, among others) or in an area with limited annulus space. Once downstream of the completion component, another hybrid junction assembly may be used in a reversed configuration to break out the various communication signals from a single hybrid line back into multiple separate control lines. The use of the hybrid junction assemblies in this manner may reduce the overall requirement for the number of control line penetrations through a specific completion component or completion section.

Variations of exemplary embodiments of hybrid junction assemblies may allow for a wide selection of the types of control lines that can be combined for penetration across the completion component. Accordingly, embodiments may include combinations of communication media commonly used with control lines, e.g., hydraulic, electrical, and optical. Embodiments may also offer such options as the ability to combine multiple hydraulic lines into a single hybrid hydraulic line, hydraulic and electric lines into a single hybrid electro-hydraulic line, hydraulic and optic lines into a single hybrid opto-hydraulic line, or electric and optic lines into a single hybrid electro-optic line. Of course, this listing is to illustrate some of the potential combinations and is not intended to be limiting, and other combinations or variations are considered to be within the scope of the disclosure.

Figure 1:
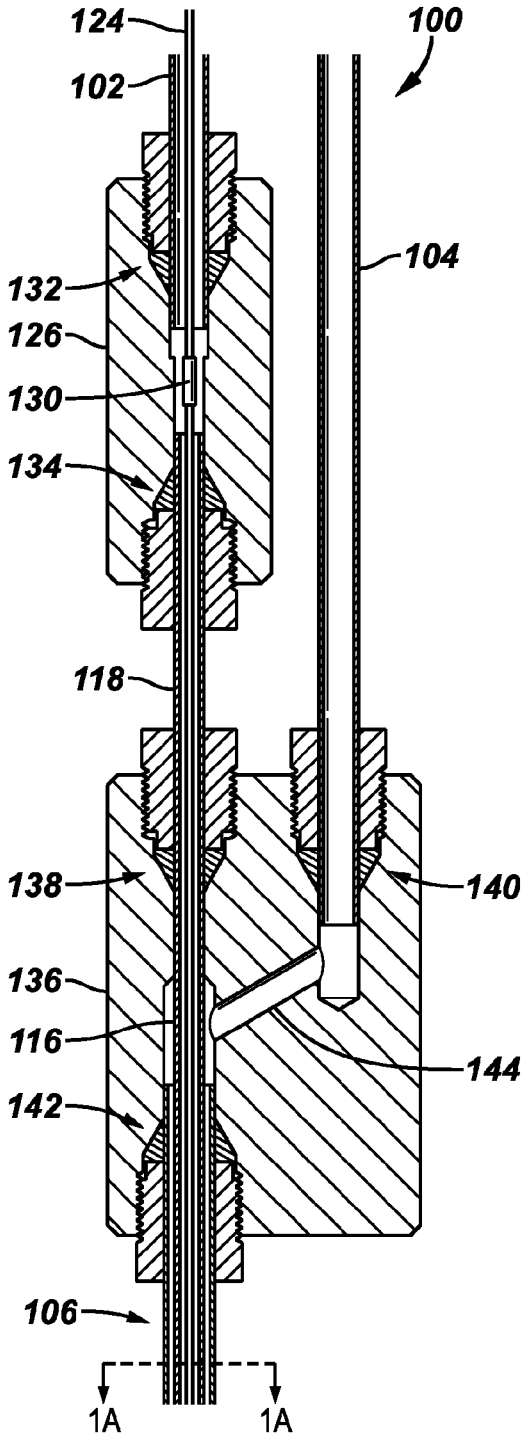
FIG. 1 is a cross-sectional side view of an exemplary hybrid junction assembly used in Coupler Mode, according to an embodiment of the disclosure.

Referring generally now to FIG. 1, an exemplary embodiment of a two-into-one hybrid junction assembly 100 according to aspects of the present disclosure is illustrated. FIG. 1 is an example of the hybrid junction assembly 100 being used in what may be referred to as "Coupler Mode," in which multiple control lines are combined into a single hybrid control line. In the embodiment shown in FIG. 1, two control lines 102 and 104 are combined into a single hybrid control line 106 for passage through, by or between a well component or section of completion, for example, such as a packer, a wellhead, etc.

Figure 2:
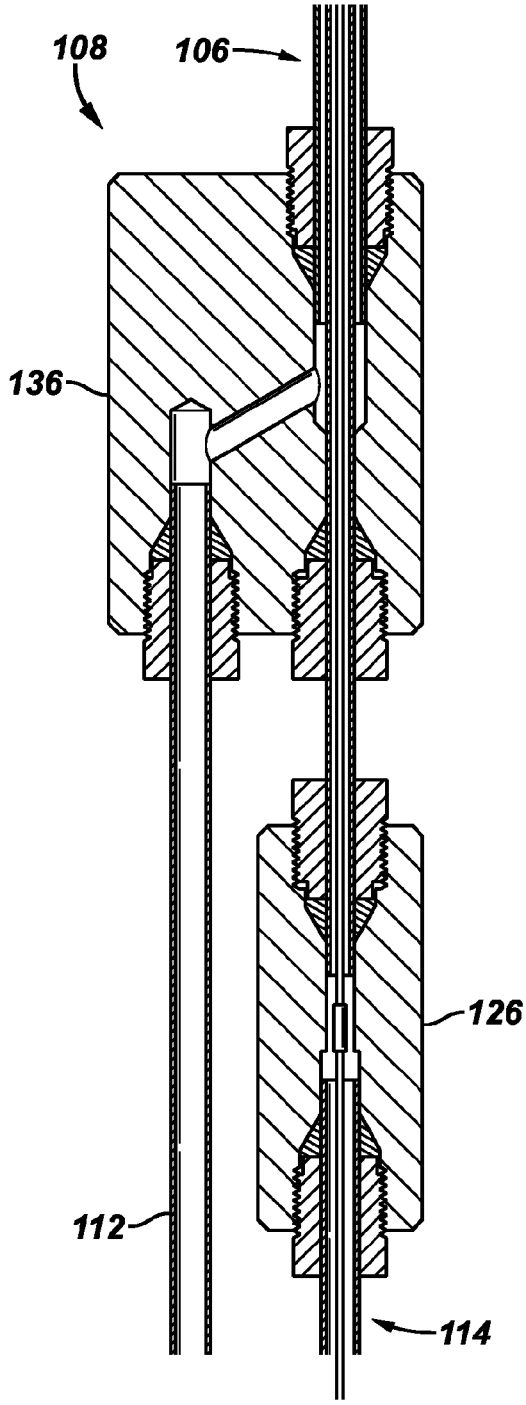
FIG. 2 is a cross-sectional side view an exemplary hybrid junction assembly used in Splitter Mode, according to an embodiment of the disclosure.

FIG. 2 illustrates a hybrid junction assembly 108 used in what may be referred to as "Splitter Mode." In Splitter Mode, the hybrid control line 106 may be reconfigured into two separate control lines 112, 114 for individual use further downhole. Of course, the use of Coupler Mode and Splitter Mode is merely for the purposes of simplifying the description and in this case, is assuming a top down methodology. Signals traveling upward through the control lines from a downhole tool to the surface would be coupled into a hybrid line at the hybrid junction assembly 108 illustrated in FIG. 2 and split back into individual control lines at the hybrid junction assembly 100 illustrated in FIG. 1. Accordingly, Coupler Mode and Splitter Mode may be interchangeably used depending upon the communication direction either up or downhole. In most cases, the following description will assume the use of Coupler Mode above the bypassed completion component or section and the use of Splitter Mode below the bypassed completion component or section.

In Coupler Mode, two control lines (e.g., which may be any combination of electric, optic, or hydraulic lines) may be combined within the hybrid junction assembly 100 into the single hybrid control line 106 containing the communication elements (e.g., hydraulic/optic/electric elements) of the two incoming control lines 102, 104. Generally, the incoming control lines 102, 104 may have outside diameters of ¼ inch, ⅜ inch, or ½ inch, for example. The single hybrid control line 106 may then be deployed across the completion component, for example. The use of a hybrid junction assembly 100 in Coupler Mode thus reduces the number of control line penetrations across the completion component by at least one. In addition, a reduction in the number of control line penetrations may result in a decrease in the number of potential leak paths across the completion component while still maintaining the ability to individually control components located even further downhole.

Below the bypass point, the hybrid junction assembly may be used in a reversed configuration (i.e., Splitter Mode) in order to break out the constituent elements of the hybrid control line. The hybrid control line may then be split into two separate control lines functionally connected to the incoming control lines previously combined together in Coupler Mode. As shown, the hybrid control line in this illustrative example may comprise either an electric or fiber optic conductor in combination with a hydraulic line. Of course, many variations and combinations of electric, optic, and hydraulic (or other communication medium) lines may be combined within a hybrid control line depending upon the particular application.

Figure 1A:
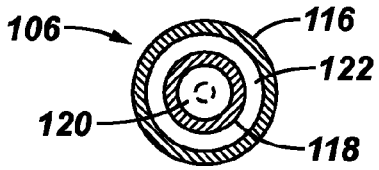
FIG. 1A is an enlarged cross-sectional view of an exemplary hybrid control line taken generally along the line A-A of FIG. 1, in accordance with an embodiment of the disclosure.

FIG. 1A provides an enlarged cross-sectional view of an exemplary embodiment of the hybrid control line 106 taken generally along the line A-A in FIG. 1. As can be seen in FIG. 1A, the hybrid control line 106 includes two concentric tubes or conduits 116, 118. The conduit 118 provides a first passageway 120 through the hybrid control line 106. The annulus formed between the outer surface of the conduit 118 and the inner surface of the conduit 116 provides a second passageway 122 through the hybrid control line 106. Either of passageways 120 and 122 may provide a communicative pathway, such as for example, for fluid (e.g., hydraulic fluid, among others). Alternatively, passageway 122 may provide a path for fluid, while passageway 120 provides a path for routing an electrical conductor, an optical fiber, etc. In this way, the hybrid control line 106 may variously be configured as a combined hydraulic line, an electro-hydraulic control line, an optic-hydraulic control line, or an electro-optical control line.

Returning again to FIG. 1, the hybrid junction assembly 100 includes incoming control lines 102, 104, which may carry any of a variety of communication media including hydraulic fluid, an electrical conductor, or a fiber optic cable. In the example shown, the communication medium 124 may be one of an electrical conductor or a fiber optic cable. The assembly 100 may further include a splice chamber 126 for receiving and providing a sealed connection between incoming control line 102 and the outgoing transfer conduit 118. In the embodiment shown, a splice 130 may be formed in the splice chamber 126 to connect one section of communication medium 124 to another section of corresponding communication medium provided in the transfer conduit 118. In order to provide a sealed connection, the incoming control line 102 and the transfer conduit 118 may be sealingly coupled to the splice chamber 126 by seals 132, 134, respectively. The seals 132, 134 may be any suitable sealing device, including a compression seal, an elastomeric seal, a metal spring energized seal, etc.

In some embodiments, the transfer conduit 118 may have an outer diameter that is the same size (or even larger) than the incoming control line 102. In other embodiments, the outer diameter of the transfer conduit 118 may be smaller than the inner diameter of the incoming control line 102. However, the outer diameter of the transfer conduit 118 is smaller than the inner diameter of the hybrid control line 106. This configuration allows the transfer conduit 118 to be received within the interior of conduit 116 (FIG. 1A) of the hybrid control line 106. For instance, in one embodiment, the outer diameter of the transfer conduit 118 may be ⅛ inch, and the hybrid control line 106 may have an outer diameter of ¼ inch, ⅜ inch, ½ inch or any other size suitable for the particular application in which the hybrid control line 106 is employed. Of course, in some cases, control line 102 may be replaced by an insulated electrical cable. In that situation, the electrical cable may function as the transfer conduit 118 and the control line 102.

The hybrid junction assembly 100 further includes a junction body 136 that may be internally ported for combining the constituent elements of the control lines 102, 104 into the hybrid control line 106. In the example shown in FIG. 1, the junction body 136 receives the transfer conduit 118 and the incoming control line 104 at a first end, where seals 138, 140 seal about and provide structural support for the transfer conduit 118 and the incoming control line 104, respectively. Seal 142 is provided at a second end of the junction body 136 to seal about and support the hybrid control line 106. Seals 138, 140, and 142 are shown as compression seals. However, it should be understood that other types of seals are envisioned, such as o-rings or other soft or elastomeric seals, metal spring energized seals, welds, etc. Regardless of the type of seal used, the seals 138, 140, 142, as well as seals 132, 134, may be pressure testable either through test ports included in the seal body (not shown) or through test ports built into the junction body 136 or splice chamber 126.

The junction body 136 includes an internal passageway or port 144 that allows a hydraulic line (i.e., control line 104) to be communicatively combined with a second hydraulic line or an electric or fiber optic line (i.e., control line 102/transfer conduit 118) via the hybrid control line 106. This combination may accomplished by positioning at least a portion of the transfer conduit 118 within the conduit 116 of the hybrid control line 106 such that an annulus 122 is formed there between. The hydraulic fluid conveyed in the control line 104 may then be communicative coupled through the port 144 and together with the annular space 122.

In embodiments in which two or more electric or fiber optic control lines, or combinations, thereof, are combined in the hybrid control line 106, the hybrid junction assembly 100 may include two splice chambers 126 above the junction body 136 in order to accommodate two electric/two optic splices. In such embodiments, port 144 may be used to direct an electrical conductor or fiber optic cable into the annular space 122 (FIG. 1A) of the hybrid control line 106.

Figure 3:
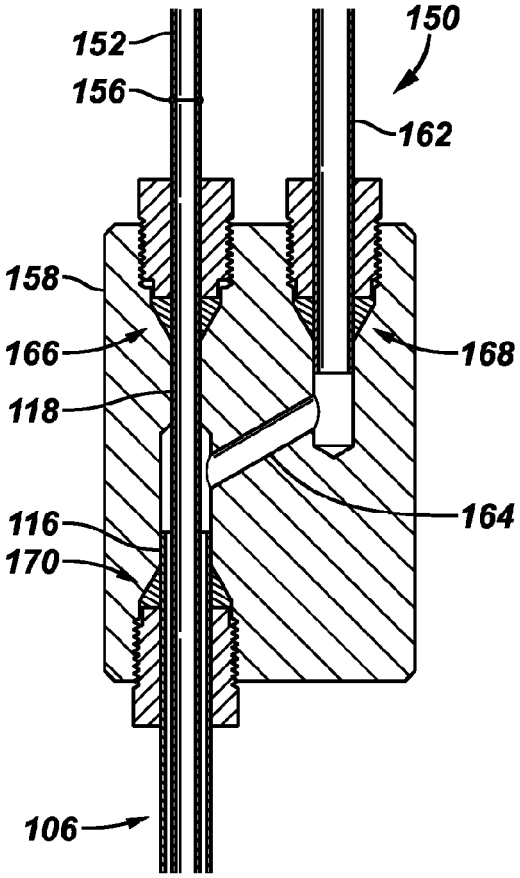
FIG. 3 is a cross-sectional side view of an exemplary hybrid junction assembly, according to another embodiment of the disclosure.

Turning now to FIG. 3, this drawing illustrates an exemplary embodiment of a hybrid control line assembly 150 comprising an alternate seal configuration (e.g., in place of sealed splice chamber 126) for the transition between an incoming control line 152 and the transfer conduit 118. For example, this exemplary embodiment 150 may use a butt weld 156 (or other type of splicing technique that provides a sealed connection) to provide a direct sealed connection between the incoming control line 152 and the transfer conduit 118, thus eliminating the need for splice chamber 126. In one embodiment, welding of the control line 152 to a component (e.g., the transfer conduit 118) of the junction body 158 may be performed in the field utilizing welding technology as described in co-pending U.S. patent application Ser. No. 12/348,442, filed, Jan. 5, 2009, and published as U.S. Patent Application Publication 2009-0277646, the contents of which are incorporated herein by reference. As shown in FIGS. 1A and 3, the transfer conduit 118 is positioned within the conduit 116 of the hybrid control line 106. The communication medium of the second incoming control line 162 is directed into the annulus 122 of hybrid control line 106 via a port 164. Incoming control lines 152 and 162 are sealingly coupled to the junction body 158 via seals 166 and 168, respectively. Hybrid control line 106 is sealingly coupled to the junction body 158 via seal 170.

The exemplary configuration shown in FIG. 3 may be suitable in applications in which the incoming control line 152 is a hydraulic line, for example. In applications in which the incoming control line 152 carries an electric or fiber optic cable, the splice chamber 126, or other type of sealing arrangement, may facilitate the sealed transition between the incoming electric/fiber optic cable in the incoming control line 152 and the transfer conduit 118.

Figure 4:
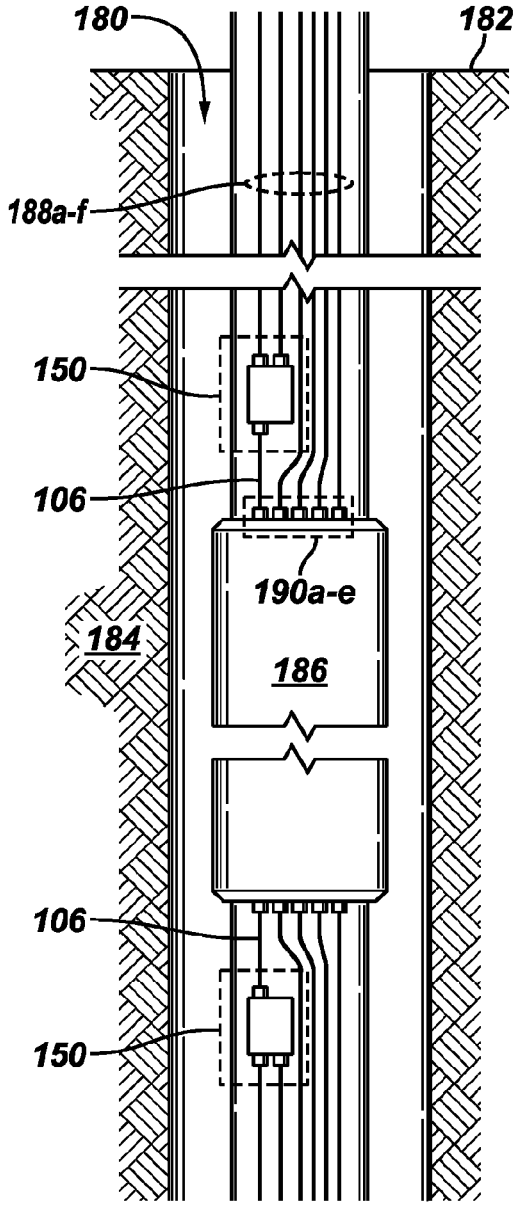
FIG. 4 illustrates a portion of a well completion including exemplary hybrid junction assemblies to bypass a completion component, in accordance with an embodiment of the disclosure.

Referring now to FIG. 4, this drawing illustrates a section of a well completion system using an exemplary two-into-one embodiment of the hybrid junction assembly 150 in a well 180 that extends from a surface 182 into a formation 184. The illustrated section is focused on the use of a hybrid junction assembly configuration to bypass one of the completion components 186, (e.g., a packer, flow control valve, etc.) in the well string. Utilizing the hybrid junction assembly 150 configuration as shown reduces the penetration requirement across the bypassed completion component 186 from six control lines 188*a-f* to five control lines (i.e., hybrid control line 106 and control lines 188*c-f*). Hybrid junction assemblies 150 may be located above and below the bypassed completion component 186, and may be mounted either on special mandrels or clamped to/around the pup joints, for example. The hybrid control line 106 and control lines 188*c-f* penetrate the component 186 at seals 190*a-e*, respectively. While the entire installation may be made up during deployment, the hybrid junction assemblies 150 may be made up with or connected to the completion component 186 at a manufacturing site.

It should be understood that while FIG. 4 illustrates the use of hybrid junction assemblies in a downhole location, hybrid junction assemblies may be employed in any location (downhole or on the surface) where it is desired to reduce the number of control lines bypassing a piece of equipment. For instance, in addition to or instead of bypassing downhole completion components, hybrid junction assemblies may also be used to bypass wellheads having a limited number of penetrations, mudline or tubing hangers used in conjunction with subsea wells, etc. Furthermore, although the configuration in FIG. 4 separates the hybrid control line 106 into separate control lines immediately downhole of the component 186, longer runs of the hybrid control line are contemplated such that a single hybrid control line 106 may bypass more than one component.

Still further, while the exemplary embodiment shown in FIG. 4 illustrates the use of hybrid junction assemblies for the reduction of the penetration count to five penetrations across the bypassed completion component 186, the concepts described herein may be used to reduce the total number of penetrations down to a single hybrid control line. The maximum number of control lines available to be subjected to reduction for deployment across the completion component may be limited primarily by space constraints regarding the volume available above and below the bypassed completion component. Additional considerations regarding the number of hybrid junction assemblies may be given to the types of control lines being reduced, the overall diameter of the hybrid control line, the amount of time to make up and test at a field location, and the amount of space available for the location of hybrid junction assemblies (e.g., is the completion tubing eccentrically or concentrically mounted in the completion component, thereby determining an offset amount of annulus space or a uniform amount of annulus space), among other considerations.

In some embodiments, hybrid junction assemblies may be deployed in stages to combine more than two control lines for penetration across the completion component. The use of stages may allow the deployment of a large number of control lines across the bypassed completion component while reducing the impact of tolerance or space restrictions imposed by the completion design and operational environments.

Figure 5:
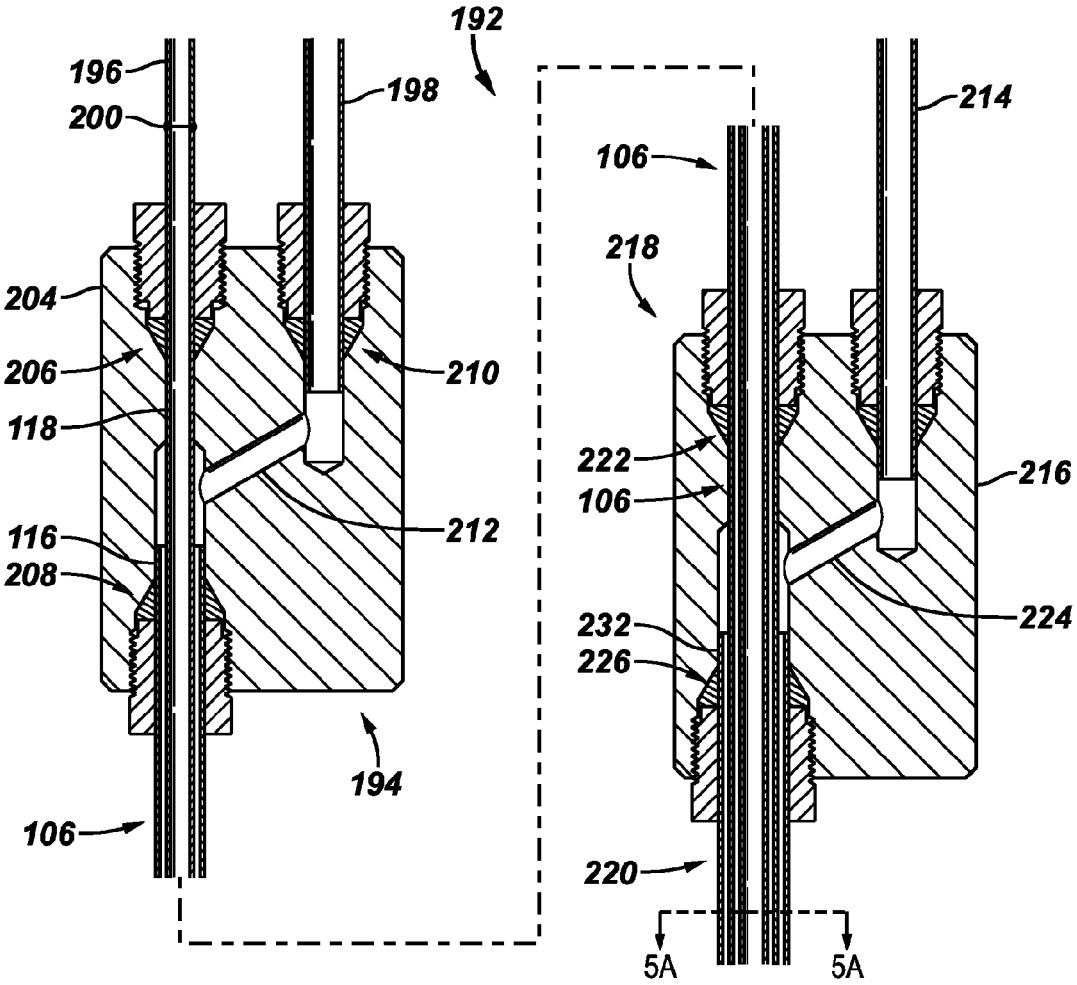
FIG. 5 is a cross-sectional side view of an exemplary multi-stage hybrid junction assembly, in accordance with an embodiment of the disclosure.

For instance, turning now to FIG. 5, this drawing illustrates an exemplary embodiment in which a three-into-one hybrid control line assembly 192 is deployed in two stages. The first stage includes a hybrid junction assembly 194 to reduce two control lines 196, 198 into the first hybrid control line 106. In the example shown, incoming control line 196 is a hydraulic control line that is butt welded 200 to the transfer conduit 118, which is sealingly coupled to junction body 204 by a seal 206. On the other side of the seal 206, the transfer conduit 118 is received in the conduit 116 (FIG. 1A) of the hybrid control line 106. The hybrid control line 106 containing the transfer conduit 118 then exits the junction body 204 through a seal 208. In this manner, the hybrid control line 106 provides a communication pathway for the control line 196 through the junction body 204.

Incoming control line 198, which also is a hydraulic control line in this illustrative example, is sealingly coupled to the junction body 204 via a seal 210. On the other side of seal 210, the control line 198 is coupled to the hybrid control line 106 through a port 212 that directs fluid from the control line 198 into the annulus 122 (FIG. 1A) formed between the inner diameter of the transfer conduit 118 and an outer diameter of the conduit 116. Thus, the hybrid control line 106 also provides a separate communication pathway for the control line 198 through the junction body 204. The hybrid control line 106 and a third incoming control line 214 are sealingly coupled to a second junction body 216 of a second hybrid control line assembly 218, where they are combined into a second hybrid control line 220. In this example, the hybrid control line 106 is received in a conduit 232 of the second hybrid control line 220 on the other side of the seal 222 (see FIG. 5A). The incoming control line 214 is coupled to the second hybrid control line 220 through a port 224 such that fluid from the control line 220 is directed into an annulus 230 (FIG. 5A) formed between the inner diameter of the conduit 232 of line 220 and the outer diameter of the hybrid control line 106. The second hybrid control line 220 exits the junction body 216 through a sealed connection 226.

After second hybrid control line 220 is routed through a completion component, for example, a reverse process may be used to separate hybrid control line 220 back into three respective control lines. With each combination, care must be taken to ensure that the proper volume exists within each of the various sections (e.g., such as the annulus between concentric conduits) of the hybrid control lines 106, 220 to ensure adequate communication pathways are provided for the proper functioning of the respective communication medium (e.g., hydraulic, electric, and/or fiber optic).

Figure 5A:
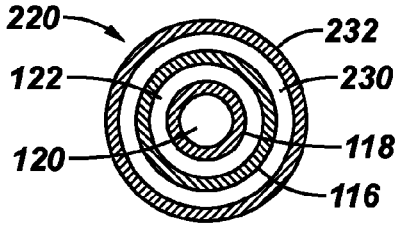
FIG. 5A is an enlarged cross-sectional view of any exemplary hybrid control line taken generally along the line A-A of FIG. 5, in accordance with an embodiment of the disclosure.

Referring directly to FIG. 5A, this drawing illustrates an enlarged cross-sectional view of the exemplary hybrid control line 220 taken generally along the line A-A of FIG. 5. Hybrid control line 220 includes three passageways 120, 122, and 230 defined by the inner diameter of conduit 118, the annulus between the inner diameter of conduit 116 and outer diameter of conduit 118, and the annulus between the inner diameter of conduit 232 and the outer diameter of conduit 116, respectively. In the embodiments illustrated thus far, the passageways of the hybrid control lines have generally been shown as concentric. It should be understood, however, that the invention is not limited to this embodiment and that other hybrid control line configurations and geometries are contemplated, including configurations having eccentric passageways, parallel passageways (e.g., such as with two non-concentric conduits within a surrounding conduit), non-tubular passageways, and so forth.

Moreover, a hybrid control line may have even a greater number of passageways, and the concept may be extended to an N-into-one configuration with N-1 hybrid junction assembly stages used in Coupler Mode above the completion component. A corresponding number of N-1 hybrid junction assembly stages may be used in Splitter Mode below the completion component. N may be a number limited by the maximum outer diameter of the Nth hybrid control line that can extend through a component penetration, the control line pressure rating requirements (which will dictate the minimum volume of the passageways), among other limitations.

Figure 6:
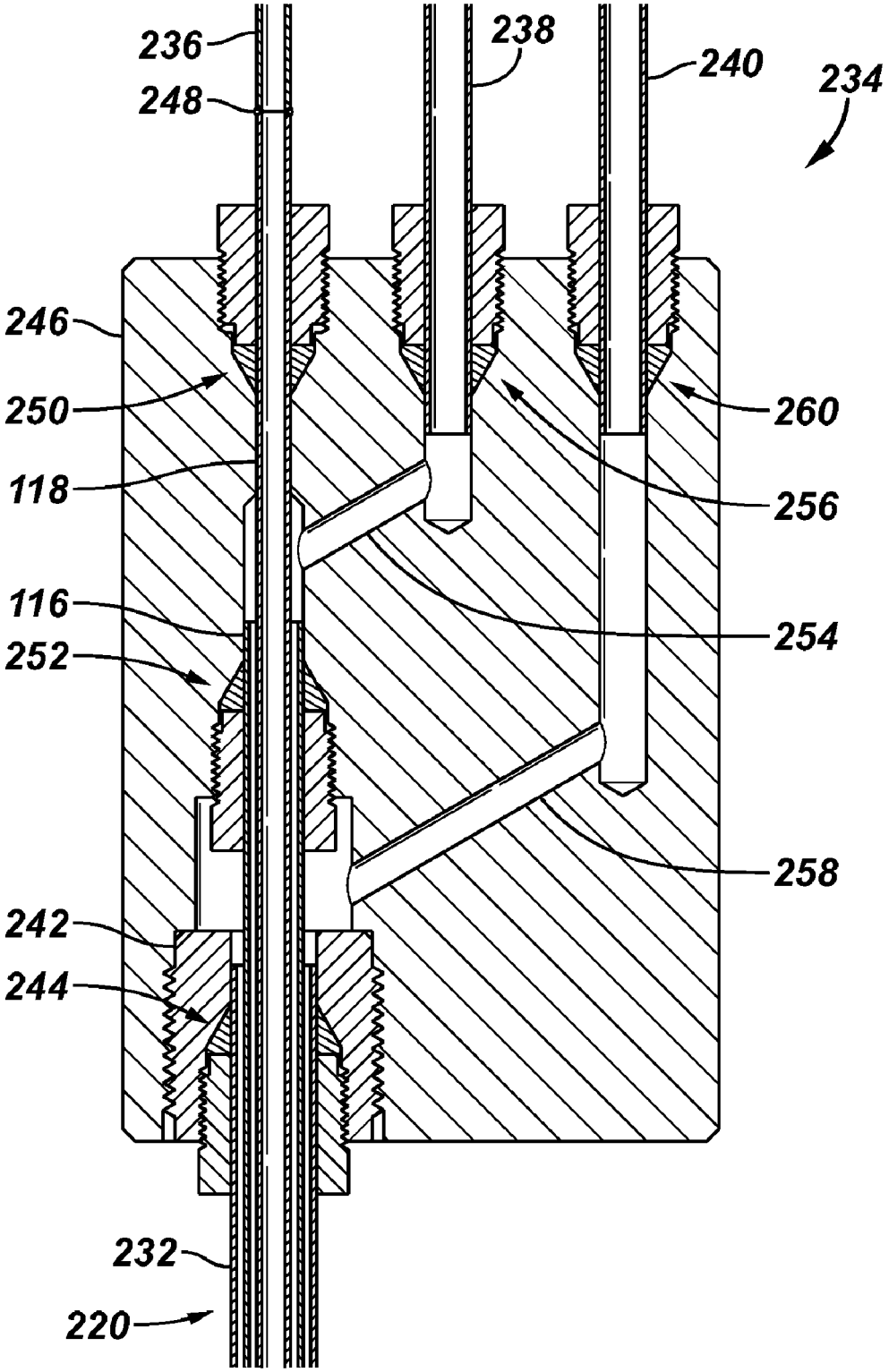
FIG. 6 is a cross-sectional side view of another exemplary hybrid junction assembly, in accordance with an embodiment of the disclosure.

Referring now to FIG. 6, this drawing illustrates an exemplary embodiment in which a single hybrid junction assembly 234 is used to reduce three control lines 236, 238, and 240 into one hybrid control line 220. As shown, control lines 236 and 238 (hydraulic lines, for example) combine into the hybrid control line 106. Hybrid control line 106 may then be combined with a third control line 240 (e.g., a hydraulic line, for example) into the hybrid control line 220. Hybrid control line 220 may then be deployed through the completion component instead of the three separate control lines, resulting in a three-into-one reduction in the number of pass throughs and potential leakage paths across the completion component.

While this type of embodiment may allow the single stage deployment of even greater number of control line reduction configurations (including for example, four-into-two, five-into-three, and five-into-two, among others), the junction body size gets progressively larger with every additional control line managed through the junction body. Additional inserts, such as insert 242, may also be required at the junction body 246 to support the cable seals (e.g., seal 244) at each transition to a progressively larger diameter hybrid control line.

As in the embodiments previously described, incoming control line 236 may be connected to the transfer conduit 118 via a butt weld 248. The transfer conduit 118 may be sealingly coupled to the junction body 246 via a seal 250. A seal 252 is positioned in the body 246 to support and seal the circumference of hybrid control line 106. A communication path between the incoming control line 238 and the hybrid control line 106 is provided via a port 254 which directs the communication medium from the incoming control line 238 to the annulus 122 (FIG. 5A) of the hybrid control line 106. Seal 256 sealingly couples line 238 to the junction body 246. The seal 244 seals the circumference of second hybrid control line 220. A communication path between the incoming control line 240 and the second hybrid control line 220 is provided via a port 258 that directs the communication medium from the line 240 to the annulus 230 (FIG. 5A) of the second hybrid control line 220. The line 240 is sealingly coupled to the junction body 246 by a seal 260.

Figure 7:
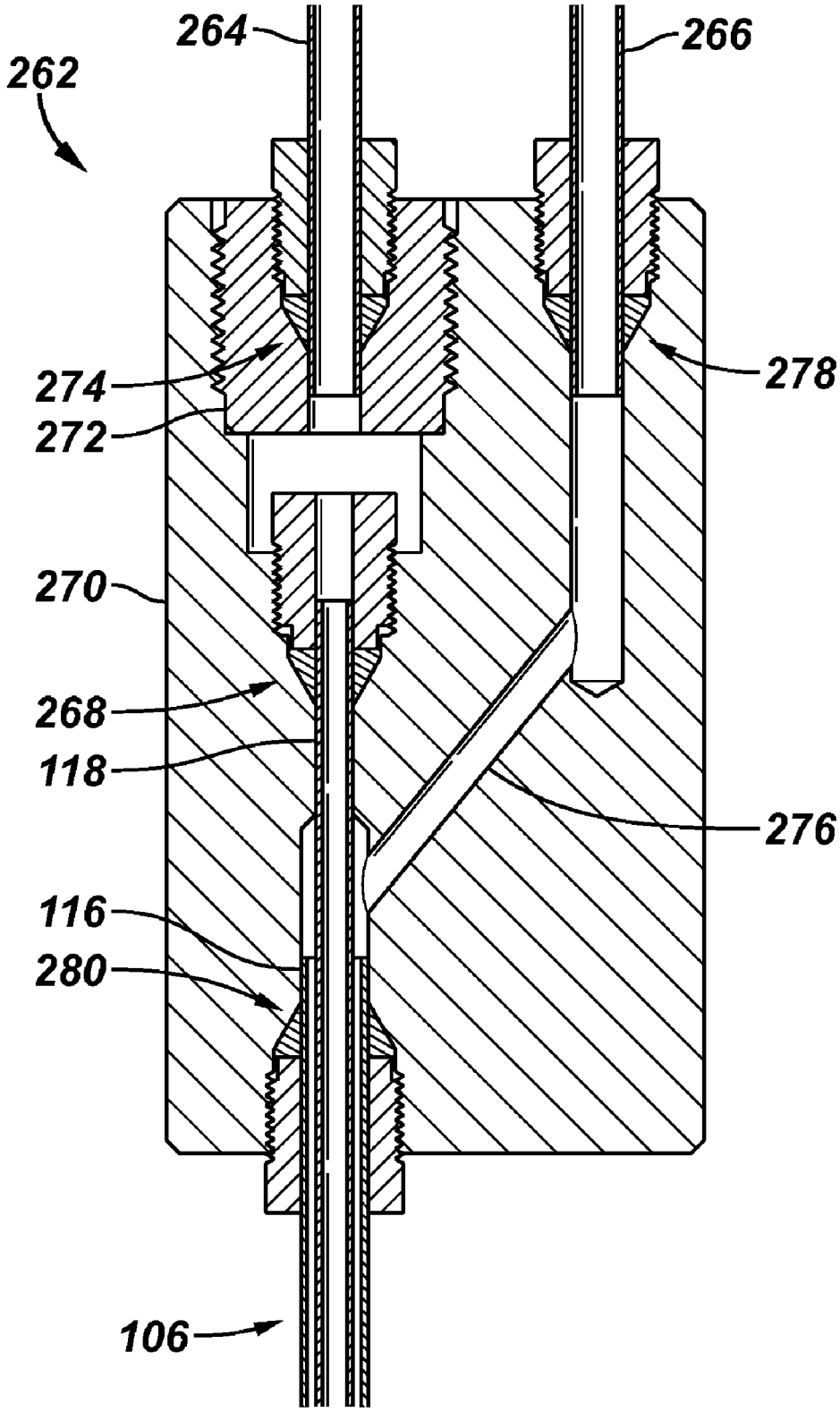
FIG. 7 is a cross-sectional side view of yet another exemplary hybrid junction assembly, in accordance with another embodiment of the disclosure.

Turning now to FIG. 7, this drawing illustrates another exemplary embodiment in which a single hybrid junction assembly 262 is used to reduce two control lines into one hybrid control line. This embodiment differs from the embodiment shown in FIG. 3 primarily with regard to the use of a compression seal 268 instead of an in line butt weld to couple the first control line 264 to the transfer conduit 118. By using an insert 272, the junction body 270 is able to separately seal and anchor transfer conduit 118 and the control line 264 to the junction body 270. As such, this single stage hybrid junction assembly 262 may function without a separate splice chamber. All various types and combinations of control lines, e.g., hydraulic, electric, and optic, may be combined or separated through the use of this single stage hybrid junction assembly. As in other embodiments, transfer conduit 118 is positioned within the conduit 116 (FIG. 1A) to from the hybrid control line 106. A communication pathway between incoming control line 266 and the hybrid control line 106 is provided by the port 276. The line 266 is sealingly coupled to the junction body 270 via a seal 278. Similarly, the hybrid control line 106 is anchored by and sealingly coupled to the junction body 270 by a seal 280.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A hybrid junction assembly comprising:

a junction body to sealingly couple to a first control line and a second control line; and a hybrid control line sealingly coupled to the junction body, the hybrid control line containing a first passageway and a second passageway therethrough, wherein the first control line is coupled to the first passageway to establish a first open pathway extending through the first control line and the junction body, and the second control line is coupled to the second passageway to establish a second open pathway extending through the second control line and the junction body, the first open pathway being separate from the second open pathway.

2. The hybrid junction assembly as recited in claim 1, wherein the first passageway and the second passageway are concentric.

3. The hybrid junction assembly as recited in claim 1, further comprising a transfer conduit positioned within the hybrid control line such that an annulus is formed between an outer surface of the transfer conduit and an inner surface of the hybrid control line, wherein the transfer conduit provides the first passageway and the annulus provides the second passageway.

4. The hybrid junction assembly as recited in claim 3, wherein the transfer conduit is sealingly coupled to the junction body.

5. The hybrid junction assembly as recited in claim 4, further comprising a splice chamber, wherein the first control line and the transfer conduit are sealingly coupled to the splice chamber to establish a sealed passageway through the splice chamber.

6. The hybrid junction assembly as recited in claim 3, wherein the second passageway is configured to convey a hydraulic fluid, and the first passageway is configured to convey one of a hydraulic fluid, an electrical conductor, and an optical fiber.

7. The hybrid junction assembly as recited in claim 1, wherein the junction body comprises a port to couple the second control line to the second passageway within the junction body.

8. The hybrid junction assembly as recited in claim 1, wherein the junction body is further configured to sealingly couple to a third control line, the hybrid control line further contains a third passageway, and the third control line is coupled to the third passageway to establish a third pathway through the junction body.

9. A method for reducing the number of control lines deployed through a downhole completion component, comprising:

coupling a first control line and a second control line to a first junction body, the first control line defining a first control line passageway and the second control line defining a second control line passageway;

coupling a hybrid control line to the first junction body, the hybrid control line containing a first hybrid control line passageway and a second hybrid control line passageway;

establishing a first open pathway through the first junction body that couples the first control line passageway to the first hybrid control line passageway; and establishing a second open pathway through the first junction body that couples the second control line passageway to the second hybrid control line passageway, the second open pathway being separate from the first open pathway.

10. The method as recited in claim 9, further comprising passing the hybrid control line through the completion component such that the first open pathway and the second open pathway pass through a single penetration of the completion component.

11. The method as recited in claim 10, further comprising coupling the first open pathway to another first control line and coupling the second open pathway to another second control line after the first open pathway and the second open pathway pass through the single penetration.

12. The method as recited in claim 11, further comprising:

coupling the hybrid control line to a second junction body;

coupling the another first control line to the second junction body to extend the first open pathway therethrough;

coupling the another second control line to the second junction body to extend the second open pathway therethrough.

13. The method as recited in claim 9, further comprising:

coupling a transfer conduit to the first junction body;

positioning the transfer conduit at least partially within the hybrid control line to establish the first open pathway coupling the first control line passageway and the first hybrid control line passageway.

14. The method as recited in claim 13, further comprising welding the first control line to the transfer conduit.

15. The method as recited in claim 13, further comprising splicing the first control line to the transfer conduit.

16. The method as recited in claim 9, further comprising:

coupling a third control line to the first junction body; and establishing a third open pathway through the first junction body between the third control line and the hybrid control line.

17. A well completion, comprising:

a completion component having a plurality of penetrations therethrough; and a hybrid junction assembly comprising:

a junction body to sealingly couple to a first control line and a second control line; and a hybrid control line sealingly coupled to the junction body, the hybrid control line containing a first passageway and a second passageway, wherein the first control line is coupled to the first passageway to establish a first open pathway extending through the junction body, and the second control line is coupled to the second passageway to establish a second open pathway extending through the junction body, the second open pathway being separate from the first open pathway, and wherein the hybrid control line bypasses the completion component through a single penetration of the plurality of penetrations.

18. The well completion as recited in claim 17 wherein the first passageway and the second passageway are concentric.

19. The well completion as recited in claim 17, further comprising a transfer conduit positioned within the hybrid control line such that an annulus is formed between an outer surface of the transfer conduit and an inner surface of the hybrid control line, wherein the transfer conduit provides the first passageway and the annulus provides the second passageway.

20. The well completion as recited in claim 17, wherein the second passageway is configured to convey a hydraulic fluid, and the first passageway is configured to convey one of a hydraulic fluid, an electrical conductor, and an optical fiber.

* * * * *